US005787517A

United States Patent [19]

Shadikhan

[11] Patent Number: 5,787,517

[45] Date of Patent: Aug. 4, 1998

[54] STANDING URINAL

[76] Inventor: Tajwar Shadikhan, 5th St. No. 5, Hong Cole Yuen Tai Rd., Hong Kong, Hong Kong

[21] Appl. No.: 845,831

[22] Filed: Apr. 28, 1997

[51] Int. Cl.[6] ..... E03D 9/00

[52] U.S. Cl. ..... 4/301; 4/302; 4/310

[58] Field of Search ..... 4/301, 302, 310, 4/311, 307, 144.1, 462, 463; D23/296, 302, 309

[56] References Cited

U.S. PATENT DOCUMENTS

| | | | |
|---|---|---|---|
| 134,315 | 12/1872 | Robinson | 4/301 |
| 293,275 | 2/1884 | Pullman | 4/311 |
| D. 352,349 | 11/1994 | Kergoet et al. | D23/302 |
| D. 354,122 | 1/1995 | Carlier | D23/302 |
| 955,485 | 4/1910 | Walsh | 4/310 |
| 1,114,670 | 10/1914 | Baker | 4/310 |
| 2,310,658 | 2/1943 | Strite et al. | 4/311 |
| 2,791,780 | 5/1957 | Krischer | 4/301 |
| 3,499,327 | 3/1970 | Lane, Jr. | 4/144.1 |
| 3,835,857 | 9/1974 | Rogers, III et al. | 128/295 |
| 4,244,061 | 1/1981 | Webster et al. | 4/144.1 |
| 4,282,611 | 8/1981 | O'Day | 4/144.1 |
| 4,549,321 | 10/1985 | Douillard | 4/301 |
| 4,570,272 | 2/1986 | Kawaguchi et al. | 4/302 |
| 4,612,676 | 9/1986 | Whitman | 4/300.3 |
| 4,665,571 | 5/1987 | Muccione | 4/144.1 |
| 5,027,448 | 7/1991 | Wilkins | 4/310 |
| 5,206,961 | 5/1993 | Rüegg | 4/252.3 |
| 5,224,222 | 7/1993 | Jones | 4/301 |
| 5,276,925 | 1/1994 | Blaha | 4/300.3 |
| 5,287,563 | 2/1994 | Peters | 4/310 |
| 5,301,374 | 4/1994 | Smiley | 4/341 |
| 5,318,498 | 6/1994 | Jones | 493/115 |
| 5,342,024 | 8/1994 | Kim | 251/40 |
| 5,450,632 | 9/1995 | Esswein et al. | 4/144.1 |
| 5,465,431 | 11/1995 | Wertz | 4/300.3 |

FOREIGN PATENT DOCUMENTS

| | | | |
|---|---|---|---|
| 6-136800 (A) | 5/1994 | Japan | 4/301 |
| 6212681 | 8/1994 | Japan . | |
| 195265 | 3/1923 | United Kingdom | 4/310 |

OTHER PUBLICATIONS

Eljer Industries Trade Literature, Hardin Urinals.
Dale Urinal Trade Literature, Back–Speed & Top–Speed Models.
Kohler Fixtures Trade Literature, Models K–4915; K–4920; K–4955; K–4960; K–4972; K–4989; K–5016; K–5024.
Kohler K–4915 Trade Literature, Bardon Touchless Model.
Kohler K–4915 Roughing–In Trade Literature.
Kohler K–4920–T Trade Literature, Branham Lite Model.
Kohler K–4955–R Trade Literature, Kingston Lite Model.
Kohler K–4955–T Trade Literature, Kingston Lite Model.
Kohler K–4960–R Trade Literature, Bardon Lite Model.
Kohler K–4989–R Trade Lierature, Freshman Lite Model.
Kohler K–5016–T Trade Literature, Dexter Lite Model.

*Primary Examiner*—Charles R. Eloshway
*Attorney, Agent, or Firm*—Christopher John Rudy

[57] ABSTRACT

A standing urinal includes an elongate, generally cylindrical housing having an elongate opening in a side of the housing. The opening extends radially a suitable but not exaggerated distance to provide side wall components of the housing, and the housing is positionable at an oblique angle to a wall to which it can be mounted, and is of such a size that when mounted to the wall a male can straddle the housing and urinate into the opening. A drain is provided in the lower portion of the housing. A supply of water can be provided for discharge inside the housing during urination so as to rinse urine away down the lower drain of the housing, and the water rinsing can be activated by an automatic switch for each urinal user.

17 Claims, 1 Drawing Sheet

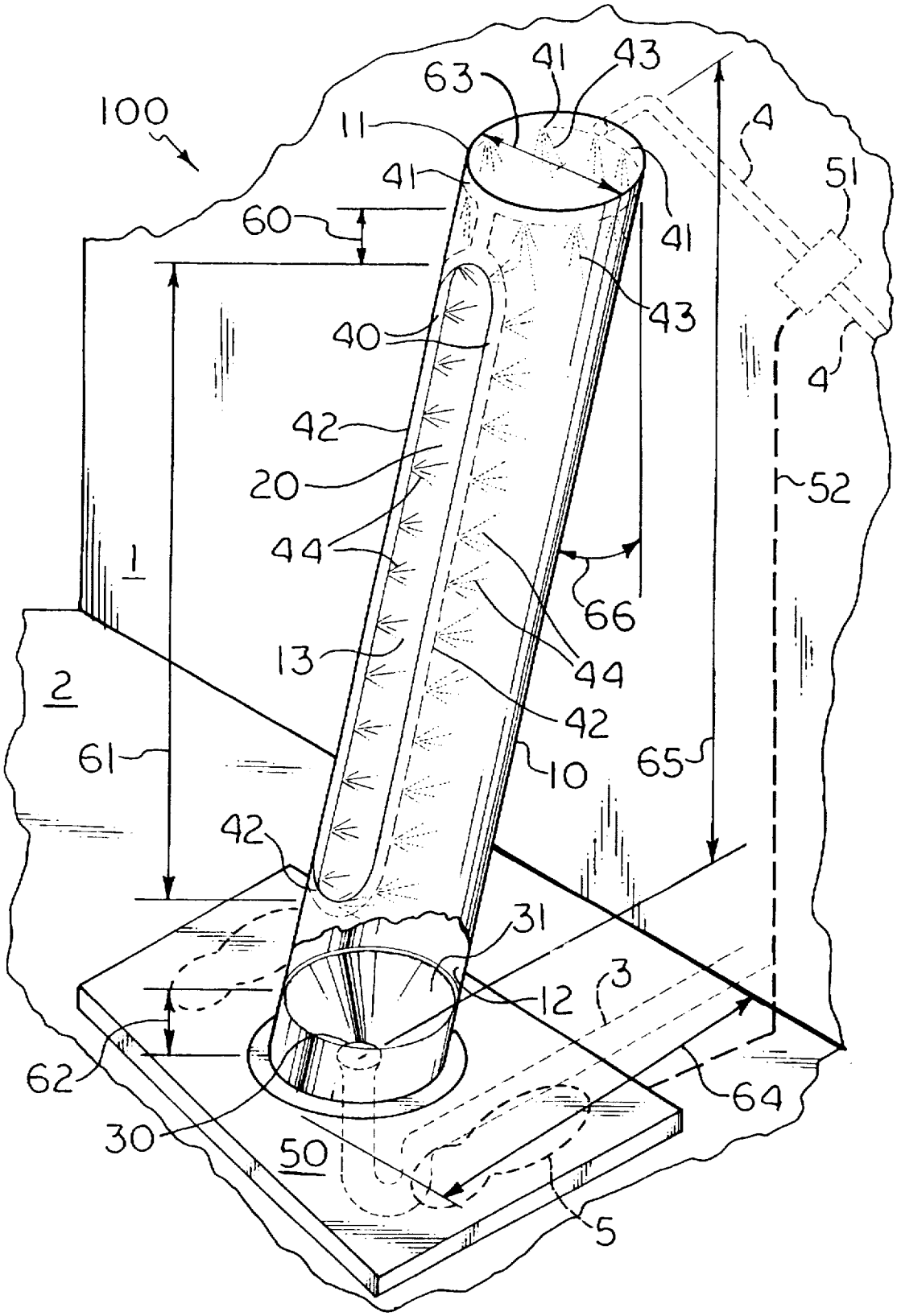
100
63
41
43
11
41
41
4
51
60
43
40
4
42
20
52
44
1
66
13
44
2
42
61
10
65
42
31
12
3
62
64
30
50
5

STANDING URINAL

FIELD

This invention concerns a urinal, especially for male use.

BACKGROUND

The male of the species is particularly endowed with an ability to urinate conveniently while in the standing position. As civilization developed, in particular as aided by the general dress-code world-wide, facilities were provided for men and boys in accommodation of this characteristic, especially in public toilet areas, also known as public bathrooms or restrooms, and the male urinal became a common men's restroom plumbing fixture.

One type of male urinal is a vertically wall-mounted plumbing fixture generally having a front-opening basin with a drain in its bottom bowl, a top ledge, and three vertical walls onto which the urine is sprayed while aiming at the back vertical wall and over which vertical walls water is flushed in an attempt to rinse residual urine down the drain. The front opening to the basin is commonly from about six inches to a foot or more in width.

Another type of male urinal is a horizontally wall-mounted elongate basin or tub generally having a bottom drain, and a top opening through which urine is passed so as to attempt to hit the sides and bottom of the basin. Water may be flushed over a side in an attempt to rinse residual urine down the drain. The top opening to the basin is commonly from about a foot to a foot and a half in width.

Unfortunately, such devices have their drawbacks as evidenced by an all too commonly encountered foul smell from urine which has not been rinsed down the drain or, worse, which has splashed out of the basin during urination and/or rinsing attempts. As well, many of such urinals have a manual flush system, which many users neglect to operate, and many automatic flush systems are less than desirable in their effect. Even if automatic flush systems work, they seldom flush the entire area where urine is exposed on a 100-percent success basis. There always seems to be some areas left unflushed. These problems are caused by a number of things, one of which is the basin configuration itself. It should be kept in mind that in the initial stage of urinal urge, the bladder is mostly full, causing a forceful gush or surge of urine. However, as the pressure gradually eases off, the flow of urine also subsides, leaving the end part of the urine and especially the last remaining urine drops to fall off quite aimlessly and very often with standard urinal systems to land on the floor, where the urine stays, and eventually smells in stagnation. Then too, in the standard urinal systems, urine is allowed, if not encouraged by design, to splash or be splashed and spread out or be spread out over a large, exaggerated surface area—perhaps in satisfaction of "a typical male ego" or perhaps to provide an outlet for alleviating boredom during urination, and this factor can engender the unwitting deposit of urine, directly or indirectly, outside the basin. In addition, use of such standard urinals by a population of males, who can be careless in operation of the urinals, can engender damage to nearby walls and even floors from the stray urine. Moreover, such stray urine can be unhygienic.

It would be desirable to overcome such drawbacks. Better hygiene in a simple, cost-efficient male urinal is particularly needed in the art.

SUMMARY

The present invention provides a standing urinal comprising an elongate, generally cylindrical housing having an elongate opening in a side thereof which opening extends radially a suitable distance to provide side wall components of the housing, which housing is positionable at an oblique angle to a wall to which it can be mounted, and is of such as size that when mounted to the wall a male can straddle the housing and urinate into the opening; and a drain in the lower portion of the housing. A supply of water can be provided for discharge inside the housing during urination so as to rinse urine away to the lower drain in the housing, and the water rinsing can be activated by an automatic switch for each urinal user.

The invention is useful in plumbing and public hygiene.

Significantly, by the invention, better hygiene is provided in a simple, cost-efficient male urinal. Most notably, the user is naturally encouraged by his straddling of the housing to aim precisely; the surge of urine is contained within the housing, and the last few drops of urine fall into the opening naturally, not on the restroom walls or floor; rinsing water can be applied during urination to almost completely if not entirely wash the urine down the drain, and the rinsing water can be controlled automatically by the presence of the user in position to urinate into the standing urinal. The housing is mounted against a wall at an oblique angle, and its opening is not exaggerated in width. Thus, excreted urine passes effectively into the standing urinal and goes down the drain. The invention is most hygienic.

Numerous further advantages attend the invention.

DRAWINGS

The drawings form part of the specification hereof. In the drawings, the sole FIGURE depicts a plan view of a standing urinal of the invention.

ILLUSTRATIVE DETAIL

The invention can be further understood by reference to the present detail, which may be taken in conjunction with the drawings. The same is to be understood in an illustrative and not necessarily limiting sense.

With reference to the drawings, in general, standing urinal 100 for male human use is mounted on wall 1 and floor 2 and has elongate housing 10 with opening 20. The generally cylindrical housing 10 would include elliptical shades and so forth. Drain 30 and rinse water system 40 are provided in the housing 10. Manual rinse water activation switch 50 is provided in or on the floor of the room where the urinal 100 is mounted. The urinal housing 10 can be of suitable size, for example, of a 140-mm to 180 mm diameter, more or less, and is mounted so as to contact the wall 1 with an upper end 11 of the housing 10. A lower end 12 of the housing 10 contacts the floor 2, and the drain 30 communicates with drain pipe 3 under the floor 2 so that urine and water can drain thereby. The rinse water system 40 communicates with water supply pipe 4 in the wall 2 so that rinse water can be provided. User 5 will activate the switch 50, which controls the water supply to the urinal 100 through valve 51 by electrical lines 52, mechanical lines, and so forth. Of course, along such lines, an electronically-controlled light beam may be employed as the switch 50.

Further, the housing 10 can have its opening 20 be open, for example, in a 30-degree to 160-degree radial arc, e.g., in a 50-degree to 60-degree arc, more or less, and the opening 20 can be open along the housing 10 a substantial distance, for example, leaving a short cylindrical portion to the housing about its upper end 11 and a short cylindrical portion about its lower end 12. The drain 30 can include concave floor 31 for proper outflow of urine and water. The rinse water system 40 can include top conduit 41 and conduit 42 surrounding the opening 20. During operation of the rinse water system 40, water streams 43 may flow out suitable orifices in the top conduit 41 and/or water streams 44 may flow out suitable orifices in the conduit 42. The water streams 43, 44 spray evenly and fully across inside surface 13 of the housing 10 so as to rinse urine away during urination into the urinal 100. The oblique angle may include 5-degree to 30-degree placements, more or less, with respect to the wall 1 and housing 10.

The urinal 100 can be made of any suitable materials, to include ceramic, vitreous chinaware, glass, stainless steel, and so forth. For example, the housing 10 can be made of a high quality ceramic with a glazed finish inside and out, and the same can be decorated with artistic depictions of sweet pea branches, with flowers, buds and leaves; the interior rinse water system 40 can be made of stainless steel, with a stainless steel strainer plate (not illustrated) set in place over the drain 30 on the drain floor 31. The floor switch 50 may be made of similar materials. External piping and connections can be of standard materials.

The urinal of the invention may have any suitable dimensions. For example, the urinal 100 as mounted can include the following dimensions, which may be considered to be approximate:

| Feature | Dimension |
|---|---|
| 60 | 50 millimeters (mm). |
| 61 | 880 mm. |
| 62 | 40 mm. |
| 63 | 160 mm. |
| 64 | 330 mm. |
| 65 | 950 mm. |
| 66 | 15 degrees. |

In use of the urinal 100, water is flushed constantly, beginning the instant one steps near the housing 10, say, on the switch 50. As a result, urine is discharged into running water rather than onto a solid surface which hopefully is to be flushed afterward. In actual sense, urine is not allowed to touch any surface—except the running water flow. The water flush system 40 closes once the user 5 leaves the switch 50 area of the urinal 100. The design of the urinal 100, with its internally generally cylindrical surface 13 mounted at an angle, is such that urine is generally not deposited elsewhere but into the housing 10 and down the drain 30.

The end result is a pleasant, clean and extremely hygienic male urinal facility 100. The urinal 100 has proven itself most effective in testing.

Complementary to the urinal 100 may be provided a matching or complimentary cigarette ash tray (not illustrated). For example, it may be made to be hung on the wall 2 beside the urinal 100, and made of the same or similar style, decoration, and color with an internal removable stainless steel container.

CONCLUSION

The present invention is thus provided. Various parts, combinations, and subcombinations may be employed independently from other parts and combinations or subcombinations and be part and parcel of the invention. Numerous modifications can be effected within its spirit, the literal claim scope of which is particularly pointed out as follows:

I claim:

1. A standing urinal comprising an elongate, generally cylindrical housing with a generally cylindrical curviplanar wall having an elongate opening along a longitudinal first side wall of the generally cylindrical curviplanar wall which opening extends radially about the longitudinal axis of the housing a suitable distance to provide second side wall components of the housing, which housing is adapted to be mounted at an oblique angle to a wall and floor with the bottom of the housing being spaced apart from the wall such that when mounted the elongate opening at the same time faces sidewardly and upwardly with respect to the wall and floor, respectively, and which housing is of such a size that when mounted to the wall and in operation a male straddles the housing and urinates into the opening; and a drain in the lower portion of the housing.

2. The urinal of claim 1, which is adapted to provide a supply of water for discharge inside the housing during urination so as to rinse urine away to the lower drain in the housing.

3. The urinal of claim 2, wherein the water rinsing is separately activated through an automatic switch by action of each urinal user.

4. The urinal of claim 3, wherein the opening is open along the housing a substantial distance, leaving a short cylindrical portion to the housing about its upper end and a short cylindrical portion to the housing about its lower end; and a rinse water system including a top conduit and a conduit surrounding the opening.

5. The urinal of claim 2, wherein the opening is open along the housing a substantial distance, leaving a short cylindrical portion to the housing about its upper end and a short cylindrical portion to the housing about its lower end; and a rinse water system including a top conduit and a conduit surrounding the opening.

6. The urinal of claim 1, which is for male human use—wherein the drain is adapted to communicate with a drain pipe so that urine and water can drain thereby; a rinse water system is provided in the housing, which is adapted to communicate with a water supply pipe so that a supply of rinse water can be provided; and a rinse water activation switch is present, which is adapted to be provided in or on the floor where the housing is to be mounted and in controlling communication with the supply of rinse water such that in use of the urinal, water is flushed constantly, beginning the instant one steps near the housing on the rinse water activation switch.

7. The urinal of claim 6, wherein the opening is open along the housing a substantial distance, leaving a short cylindrical portion to the housing about its upper end and a short cylindrical portion to the housing about its lower end; and the rinse water system includes a top conduit and a conduit surrounding the opening.

8. A urinal for male human use comprising an elongate, generally cylindrical housing adapted to be mounted on a wall and floor so as to contact the wall with an upper end of the housing and the floor with a lower end of the housing; an elongate opening in a side of the housing, which opening extends radially a suitable distance to provide side wall components of the housing, which housing is positioned at an oblique angle to the wall to which it is mounted, and is of such a size that when mounted to the wall a male can straddle the housing and urinate into the opening; a drain in the lower portion of the housing, which is adapted to communicate with a drain pipe so that urine and water can drain thereby; a rinse water system provided in the housing, which is adapted to communicate with a water supply pipe so that rinse water can be provided; and a rinse water activation switch adapted to be provided in or on the floor where the housing is to be mounted such that in use of the urinal, water is flushed constantly, beginning the instant one steps near the housing on the rinse water activation switch—wherein the housing has its opening open in an about 30-degree to 160-degree radial arc; the opening is open along the housing a substantial distance, leaving a short cylindrical portion to the housing about its upper end and a short cylindrical portion about its lower end; the drain includes a concave floor for proper outflow of urine and water; the rinse water system includes a conduit surrounding the opening such that, during operation of the rinse water system, water streams flow out suitable orifices in the conduit surrounding the opening, which water streams spray evenly and fully across an inside surface of the housing so as to rinse urine away during urination into the urinal.

9. The urinal of claim 8, which includes manufacture from a material selected from the group consisting of ceramic, vitreous chinaware, glass and stainless steel.

10. The urinal of claim 9, wherein the opening is open along the housing a substantial distance, leaving a short cylindrical portion to the housing about its upper end and a short cylindrical portion to the housing about its lower end; and the rinse water system includes a top conduit and a conduit surrounding the opening.

11. In combination with a bathroom having a wall and floor, a standing urinal comprising an elongate, generally cylindrical housing with a generally cylindrical curviplanar wall having an elongate opening along a longitudinal first side wall of the generally cylindrical curviplanar wall which opening extends radially about the longitudinal axis of the housing a suitable distance to provide second side wall components of the housing, which housing is mounted to and positioned at an oblique angle to the wall and floor with the bottom of the housing being spaced apart from the wall such that the elongate opening at the same time faces sidewardly and upwardly with respect to the wall and floor, respectively, and which housing is of such a size that in operation a male straddles the housing and urinates into the opening; and a drain in the lower portion of the housing.

12. The combination of claim 11, which is adapted to provide a supply of water for discharge inside the housing during urination so as to rinse urine away to the lower drain in the housing.

13. The combination of claim 12, wherein the water rinsing is activated through an automatic switch by action of each urinal user.

14. The combination of claim 16, wherein the opening is open along the housing a substantial distance, leaving a short cylindrical portion to the housing about its upper end and a short cylindrical portion to the housing about its lower end; and a rinse water system including a top conduit and a conduit surrounding the opening.

15. The combination of claim 12, wherein the opening is open along the housing a substantial distance, leaving a short cylindrical portion to the housing about its upper end and a short cylindrical portion to the housing about its lower end; and a rinse water system including a top conduit and a conduit surrounding the opening.

16. The combination of claim 11, which is for male human use—wherein the drain communicates with a drain pipe so that urine and water drains thereby; a rinse water system is provided in the housing, which communicates with a water supply pipe so that rinse water is provided; and a rinse water activation switch is provided in or on the floor where the housing is mounted and in controlling communication with the supply of water such that in use of the urinal, water is flushed constantly, beginning the instant one steps near the housing on the rinse water activation switch.

17. The combination of claim 16, wherein the opening is open along the housing a substantial distance, leaving a short cylindrical portion to the housing about its upper end and a short cylindrical portion to the housing about its lower end; and the rinse water system includes a top conduit and a conduit surrounding the opening.

* * * * *

UNITED STATES PATENT AND TRADEMARK OFFICE

CERTIFICATE OF CORRECTION

PATENT NO. : 5,787,517

DATED : Aug. 4, 1998

INVENTOR(S) : Tajwar Shadikhan

It is certified that error appears in the above-identified patent and that said Letters Patent is hereby corrected as shown below:

On the front page of the patent, block identification No. 76, Inventor data, line 2 thereof, delete "Hong Cole Yuen Tai Rd.,"

and insert therefor

-- Hong Lok Yuen, Tai Po, --.

Signed and Sealed this

Seventeenth Day of November, 1998

Bruce Lehman

*Attest:*

BRUCE LEHMAN

*Commissioner of Patents and Trademarks*

*Attesting Officer*